US007857070B2

(12) United States Patent
Harber et al.

(10) Patent No.: US 7,857,070 B2
(45) Date of Patent: Dec. 28, 2010

(54) CONTROL SYSTEM USING A SINGLE PROPORTIONAL VALVE

(75) Inventors: Neil Vincent Harber, Holy Cross, IA (US); Luke John Kurth, Dubuque, IA (US); Darrel Jeffrey Rowan, Dubuque, IA (US)

(73) Assignee: Deere & Company, Moline, IL (US)

( * ) Notice: Subject to any disclaimer, the term of this patent is extended or adjusted under 35 U.S.C. 154(b) by 566 days.

(21) Appl. No.: 11/405,850

(22) Filed: Apr. 18, 2006

(65) Prior Publication Data

US 2007/0253840 A1 Nov. 1, 2007

(51) Int. Cl.
*E02F 3/85* (2008.01)

(52) U.S. Cl. ..... 172/2; 172/812

(58) Field of Classification Search ..... 172/2, 172/4.5, 812, 468, 471
See application file for complete search history.

(56) References Cited

U.S. PATENT DOCUMENTS

| | | | | |
|---|---|---|---|---|
| 5,394,697 | A * | 3/1995 | Hirata | 60/426 |
| 5,467,829 | A * | 11/1995 | Barton et al. | 172/4.5 |
| 5,488,787 | A * | 2/1996 | Aoyagi et al. | 37/348 |
| 5,682,955 | A * | 11/1997 | Groth et al. | 172/811 |
| 6,650,985 | B2 * | 11/2003 | Lin et al. | 701/50 |
| 7,155,909 | B2 * | 1/2007 | Toji | 60/468 |
| 7,269,944 | B2 * | 9/2007 | Zhang et al. | 60/414 |
| 2002/0112475 | A1 * | 8/2002 | Cannestra | 60/468 |
| 2007/0089408 | A1 * | 4/2007 | Toji | 60/444 |

* cited by examiner

*Primary Examiner*—Thomas B Will
*Assistant Examiner*—Joel F. Mitchell
(74) *Attorney, Agent, or Firm*—Baker & Daniels LLP

(57) ABSTRACT

The present invention relates to machinery having multiple hydraulically actuated functions and, more particularly, to a control system for using a single proportional valve to control multiple hydraulically actuated functions on a piece of machinery such as a tractor or front-end wheel loader.

25 Claims, 5 Drawing Sheets

CONTROL SYSTEM USING A SINGLE PROPORTIONAL VALVE

BACKGROUND AND SUMMARY OF THE INVENTION

The present invention relates to machinery having multiple hydraulically actuated functions and, more particularly, to a control system for using a single proportional valve to control multiple hydraulically actuated functions on a piece of machinery such as a tractor or front-end wheel loader.

Construction machinery such as road graders and front-end wheel loaders as well as farm machinery such as farm tractors typically include a plurality of hydraulically actuated features or functions such as a front end loader, grading blade, backhoe assembly, etc. These features may include multiple hydraulically actuated movements. For example, a road grader may include a blade lift, blade tilt, and ripper lift, which all may require separate hydraulic cylinders for operation. In addition, these vehicles, particularly farm tractors may be hydraulically coupled to an implement such as a planter, cultivator, or other farm implement. Some implements may include hydraulic systems that articulate or operate particular features of the implement such as lifting or extending wheels. Generally, an input such as a joystick and/or a plurality of selector switches is mounted in the cab or on a panel of the machinery. The input allows an operator to control the hydraulically actuated functions of the construction machinery or implement.

According to an illustrative embodiment of the present invention, a control system for a construction apparatus includes a hydraulic pump adapted to supply hydraulic fluid to a plurality of hydraulically actuated functions, the control system comprising a proportional valve adapted to selectively control a flow of hydraulic fluid from the hydraulic pump, a plurality of direction valves in communication with the proportional valve and the plurality of hydraulically actuated functions, the directional valves configured to selectively direct hydraulic fluid from the proportional valve to at least one of the hydraulically actuated functions, a first input adapted to actuate the proportional valve to control the flow of hydraulic fluid from the pump to the plurality of directional valves, and a second input adapted to actuate at least one of the plurality of directional valves to supply hydraulic fluid to a corresponding hydraulically actuated function.

According to a further illustrative embodiment of the present invention, a construction apparatus comprises a hydraulic pump adapted to produce pressurized hydraulic fluid, a proportional valve adapted to control a flow rate of hydraulic fluid supplied by the hydraulic pump, a plurality of hydraulically actuated implements, a plurality of inputs, at least one of the inputs corresponding to the proportional valve, at least one of the inputs corresponding to one of the hydraulically actuated implements, and a plurality of directional valves in communication with the proportional valve and the plurality of hydraulically actuated implements, the plurality of directional valves adapted to receive input from the plurality of inputs and direct hydraulic fluid from the proportional valve to the corresponding hydraulically actuated implement.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
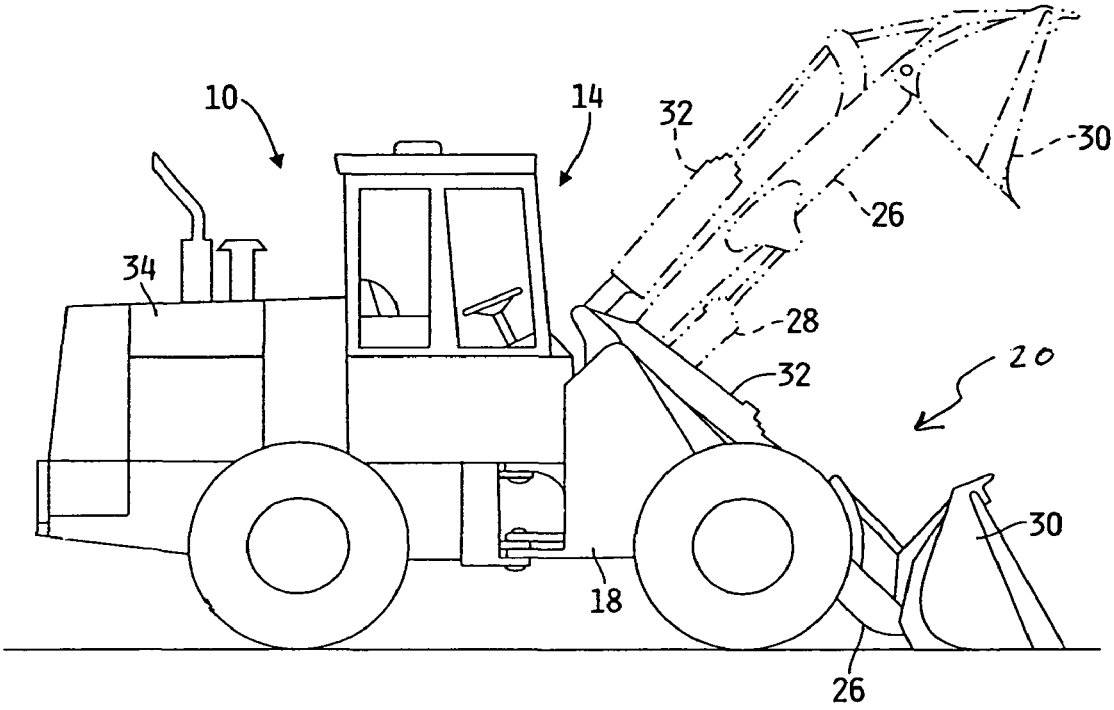
FIG. 1 is a side view of an illustrative embodiment of a front-end wheel loader.

Referring initially to FIG. 1, one embodiment of a wheel loader 10 is shown. Wheel loader 10 includes a motor 34, a cab 14, a frame 18, and a boom assembly 20. Boom assembly 20 includes a boom 26, a boom cylinder 28, a bucket 30, and a bucket cylinder 32. Boom 26 is pivotally coupled to frame 18 and may be raised and lowered by extending or retracting boom cylinder 28. Bucket 30 is pivotally coupled to boom 26 and may be articulated by extending or retracting bucket cylinder 32. Wheel loader 10 and specifically boom assembly 20 are controlled by an operator and a plurality of controls (not shown) located in cab 14. An example of operator controls is discussed below.

Figure 2:
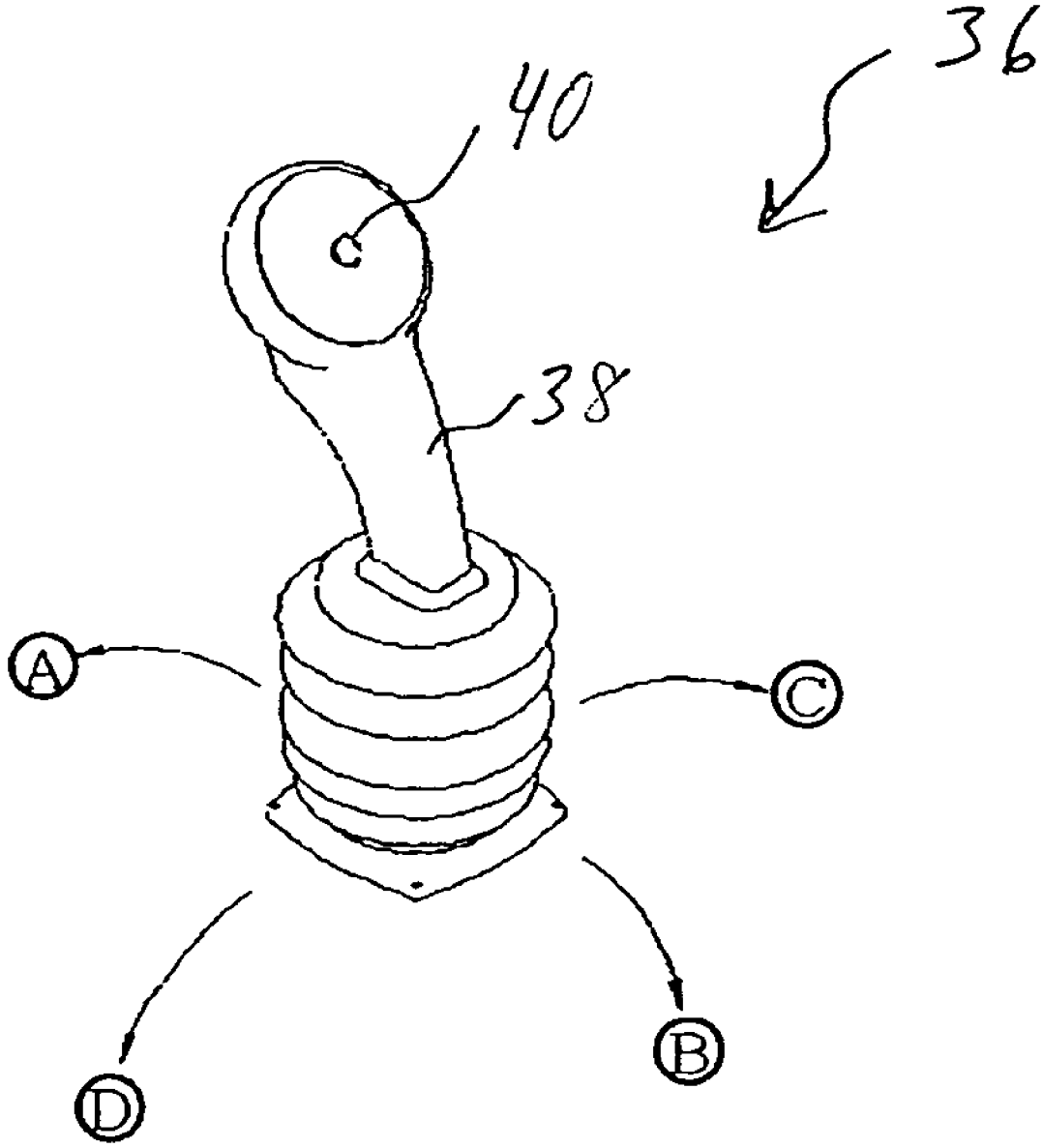
FIG. 2 is an elevated, profile view of one embodiment of an input that may be used in a the front-end wheel loader shown in FIG. 1.

Referring now to FIG. 2, one embodiment of an operator input or control 36 is shown. Input 36 may be located in cab 14 of wheel loader 10 or any other suitable location. In this embodiment, input 36 includes a joystick 38 and a selector 40. Joystick 38 is movable in four directions (A, B, C, D). Selector 40 may be a push button or any other suitable input that may be used by the operator to switch between or select one of the hydraulically actuated functions of wheel loader 10. As described in more detail below, the operator may select any one of a plurality of hydraulically actuated functions of wheel loader 10 that will then be controlled by joystick 38.

Figure 3:
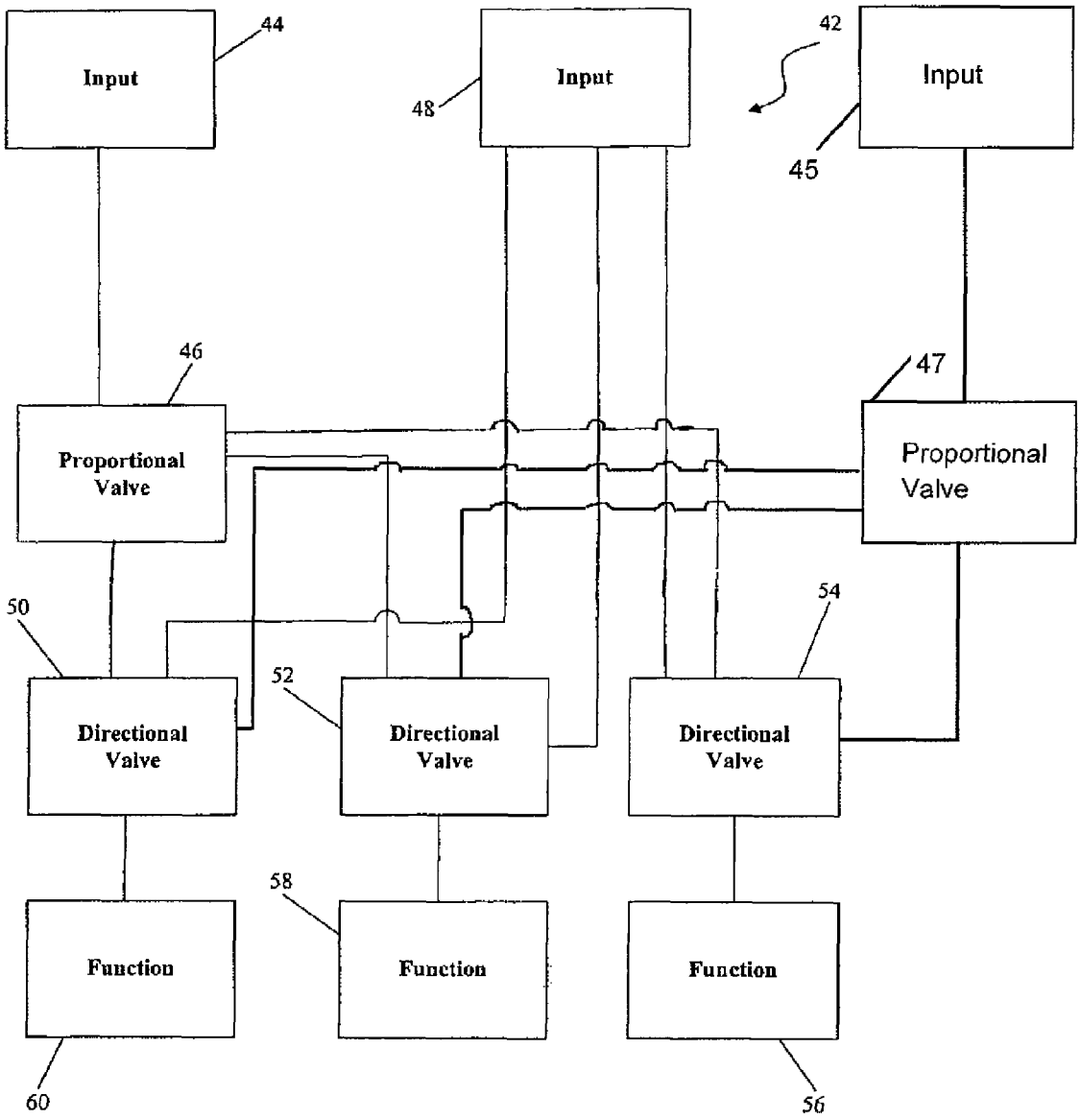
FIG. 3 is a block diagram of the illustrative embodiment control system of the present invention.

Referring now to FIG. 3, a flow chart illustrating one embodiment of a control system of the present invention is shown. Control system 42 may be used to control a plurality of hydraulically actuated functions using only a single proportion valve. In the embodiment of control system 42 shown in FIG. 3, input 44 is coupled to a proportional valve 46 and input 48 is coupled to a plurality of directional valves 50, 52, and 54. In an alternative embodiment of control system 42 is also shown in FIG. 3, a second proportional valve 47 is adapted to receive input from at least one of the plurality of inputs, such as input 45. Proportional valve 46 receives pressurized hydraulic fluid from a hydraulic pump (not shown) and varies the output or flowrate of pressurized hydraulic fluid based on input 44. Input 44 may be actuated by an operator or other device such as a computer processor to control the flowrate of pressurized hydraulic fluid passing through proportional valve 46. In this embodiment, proportional valve 46 selectively supplies pressurized hydraulic fluid to directional valves 50, 52, and 54. In an alternative embodiment, a second proportional valve 47 is adapted to selectively supply hydraulic fluid to the plurality of directional valves 50, 52, and 54. Input 48 is coupled to directional valves 50, 52, and 54 and may be used to select at least one of hydraulically actuated functions 56, 58, and 60 to receive pressurized hydraulic fluid from proportional valve 46. When an operator selects a function with input 48, for example function 58, directional valve 52 is opened to allow fluid communication between proportional valve 46 and function 58. The operator may then use input 44 to open and close proportional valve 46 to operate hydraulically actuated function 58.

Applying control system 42 to wheel loader 10 and input 36, as shown in FIGS. 1 and 2, joystick 38 may be input 44 and selector 40 may be input 48 of control system 42. Hydraulically actuated functions 56, 58, and 60 may be boom cylinder 28, bucket cylinder 32, and an accessory port used with any suitable hydraulic attachment. For this example, the operator may desire to lift boom 26 as shown in phantom in FIG. 1. The operator first selects to control boom cylinder 28 using selector 40 which powers directional valve 54 to open allowing fluid to flow between proportional valve 46 and boom cylinder 56. The operator then uses joystick 38 to actuate proportional valve 46 to allow pressurized hydraulic fluid to pass through directional valve 54 to boom cylinder 28 to lift boom 26.

In another embodiment of control system 42, multiple inputs may be used to control directional valves 50, 52, and 54. For example, in addition to selector 40 of input 36 shown in FIG. 2, movement of joystick 38 in the side-to-side (C to D, D to C) direction or the back and forth (A to B, B to A) direction may automatically select one of the directional valves to open to control a predetermined function. It should be understood by one having ordinary skill in the art that control system 42 may used on any suitable construction apparatus or agricultural tractor. Additionally, any suitable number of inputs and directional valves may be used to direct hydraulic fluid flow from a single proportional valve to a plurality of hydraulically actuated functions.

Figure 4:
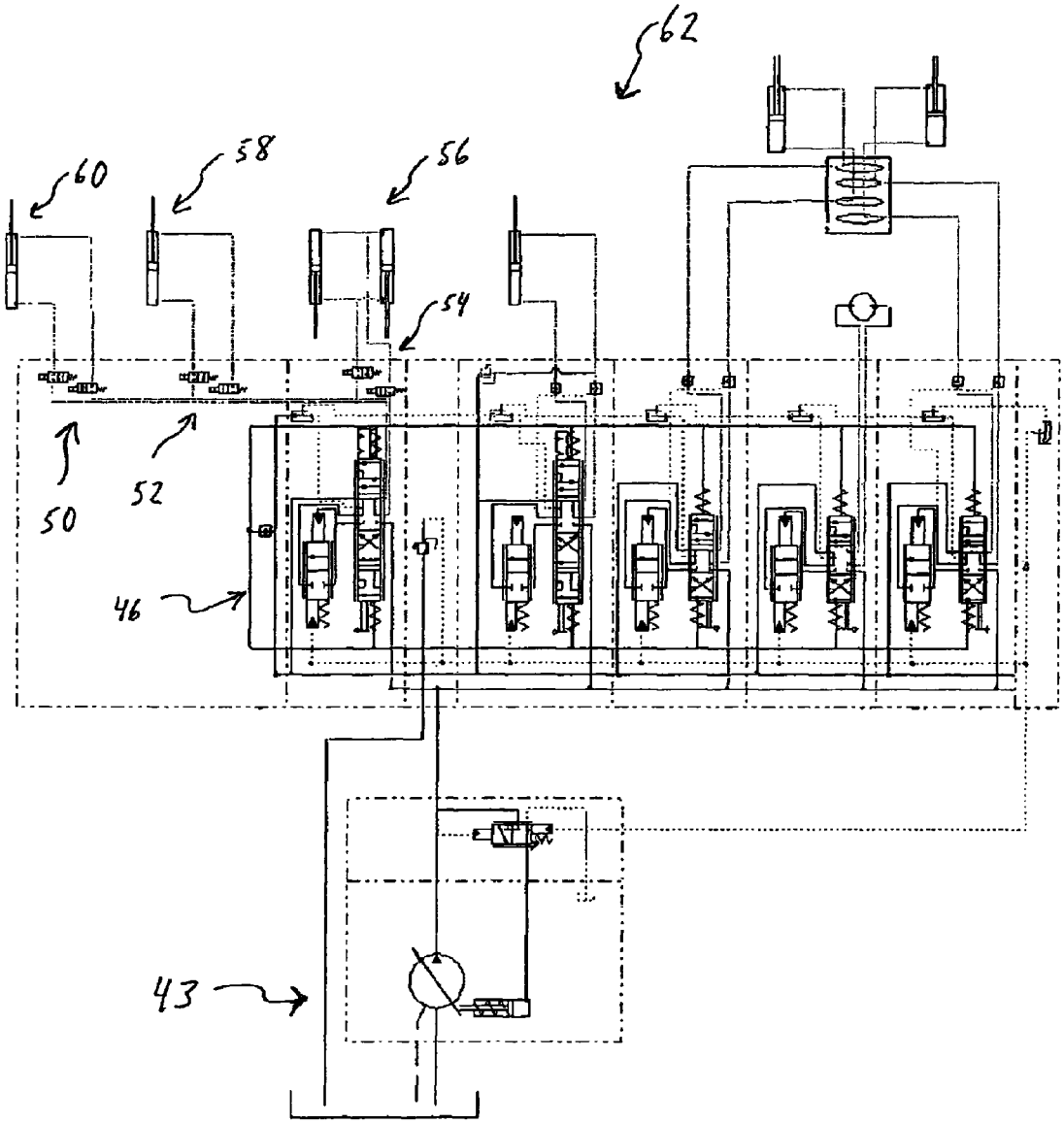
FIG. 4 is a schematic view of one embodiment of the hydraulic control system of FIG. 3 for controlling hydraulically actuated implements of a construction apparatus such as the front-end wheel loader shown in FIG. 1.

Referring now to FIG. 4, a schematic 62 for one embodiment of control system 42 is shown. Schematic 62 includes hydraulic pump 43, proportional valve 46, and pairs of directional valves 50, 52, and 54. In this embodiment, a pair of directional valves is used of for each hydraulically actuated function 56, 58, 60. One directional valve of the pair is positioned in the fluid supply line supplying pressurized hydraulic fluid to the function while the other directional valve of the pair is positioned in the return line that allows displaced hydraulic fluid to flow back into the system. In this embodiment, the pairs of directional valves 50, 52, and 54 are solenoid actuated, spring return electro-hydraulic valves, however any suitable directional valves may be used. As discussed above, when the operator selects one of the hydraulically actuated functions 56, 58, and 60, the corresponding pair of directional valves 50, 52, and 54 is powered to open to allow hydraulic fluid low from proportional valve 46 to the selected hydraulically actuated function.

Figure 5:
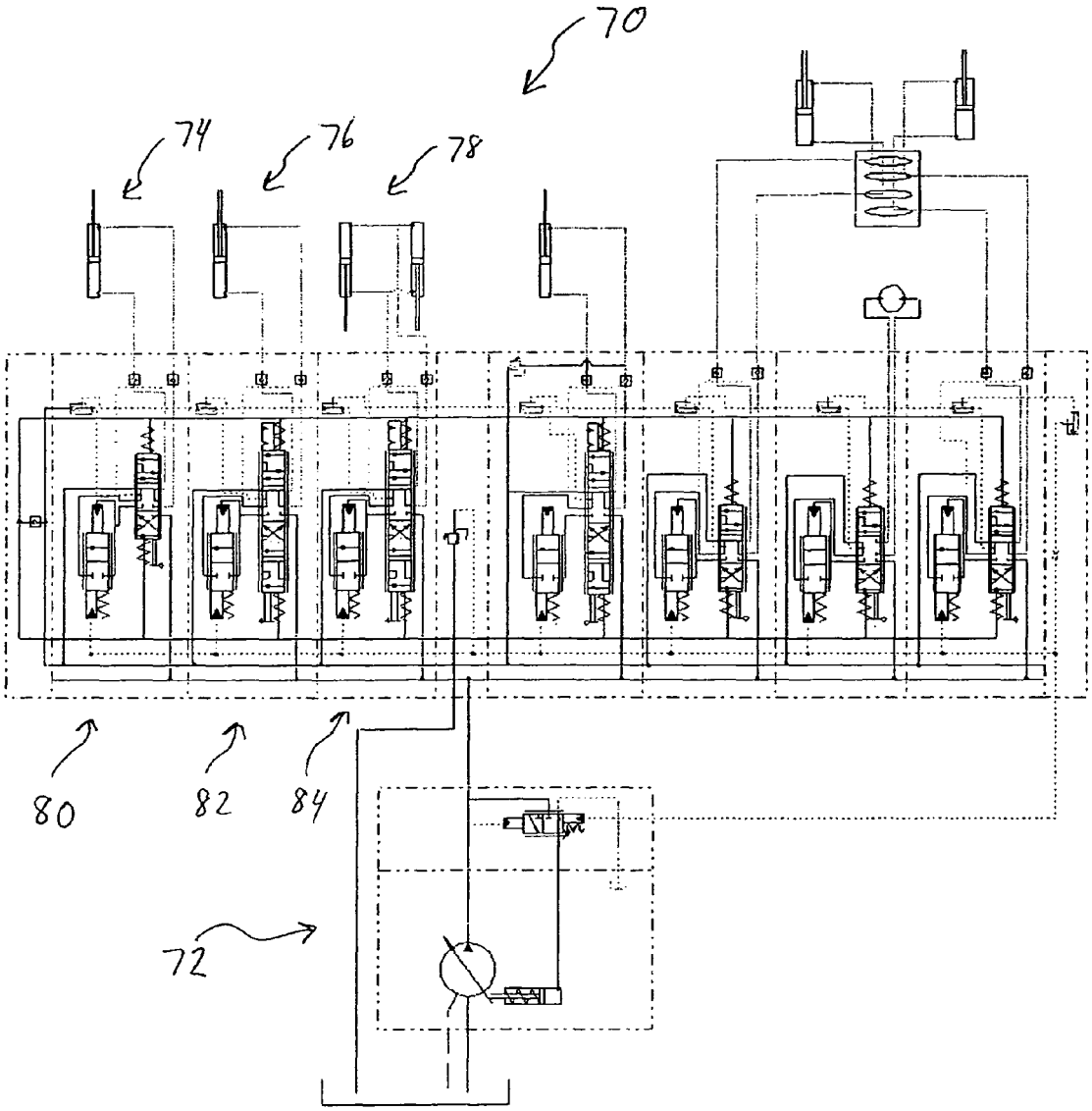
Fig. 5 (prior art)
FIG. 5 is a schematic view of a prior art hydraulic control system for controlling hydraulically actuated implements of a construction apparatus such as the front-end wheel loader shown in FIG. 1.

A schematic of a prior art control system 70 is shown in FIG. 5. Control system 70 includes a hydraulic pump 72, three proportional valves 80, 82, and 84, and three corresponding hydraulically actuated functions 74, 76, and 78. In this embodiment, each hydraulically actuated function requires a corresponding proportional valve. Each proportional valve 80, 82, and 84 is coupled to an input configured to open or close the corresponding proportional valve. Each of the proportional valves directly controls the corresponding hydraulically actuated function after receiving input from an operator or computer control system.

Although the invention has been described in detail with reference to certain preferred embodiments, variations and modifications exist within the spirit and scope of the invention as described and defined in the following claims.

The invention claimed is:

1. A control system for a construction apparatus including a hydraulic pump adapted to supply hydraulic fluid to a plurality of hydraulically actuated functions, the control system comprising:

a proportional valve adapted to selectively control a flow of pressurized hydraulic fluid from the hydraulic pump;

a plurality of directional valves in communication with the proportional valve and the plurality of hydraulically actuated functions, the directional valves configured to selectively direct the pressurized hydraulic fluid from the proportional valve to at least one of the hydraulically actuated functions, wherein the proportional valve includes a first outlet directing pressurized fluid to a first of the plurality of directional valves and a second outlet directing pressurized fluid to a second of the plurality of directional valves;

a first input adapted to actuate the proportional valve to control the flow of hydraulic fluid from the pump to the plurality of directional valves; and a second input adapted to actuate at least one of the plurality of directional valves to supply hydraulic fluid to a corresponding hydraulically actuated function.

2. The control system of claim 1, wherein the construction apparatus is a motor grader.

3. The control system of claim 2, wherein the plurality of hydraulically actuated functions includes at least one of a blade lift, a ripper, and a blade tilt.

4. The control system of claim 1, wherein the proportional valve is a manually controlled valve.

5. The control system of claim 1, wherein the proportional valve is an electro-hydraulic valve.

6. The control system of claim 1, wherein the plurality of directional valves are electro-hydraulic valves.

7. The control system of claim 1, further comprising a second proportional valve adapted to selectively supply hydraulic fluid to the plurality of directional valves.

8. The control system of claim 1, further comprising a processor configured to receive input from the first and second inputs and actuate the proportional valve and at least one of the directional valve.

9. The control system of claim 1, further comprising a processor configured to control the proportional valve.

10. The control system of claim 1, wherein the first input is a joystick and the second input is a selector switch corresponding to one of the plurality of hydraulically actuated functions.

11. The control system of claim 1, wherein a flow path of pressurized hydraulic fluid is provided between the pump and at least one of the directional valves, the proportional valve is positioned downstream of the pump and upstream of the at least one direction valve.

12. The control system of claim 1, wherein the proportional valve controls the flow of pressurized fluid to the plurality of directional valves.

13. A construction apparatus comprising:

a hydraulic pump adapted to produce pressurized hydraulic fluid;

a proportional valve adapted to control a flow rate of pressurized hydraulic fluid supplied by the hydraulic pump;

a plurality of hydraulically actuated implements;

a plurality of inputs, at least one of the inputs corresponding to the proportional valve, at least one of the inputs corresponding to one of the hydraulically actuated implements; and a plurality of directional valves in communication with the proportional valve and the plurality of hydraulically actuated implements, the plurality of directional valves adapted to receive input from the plurality of inputs and direct hydraulic fluid from the proportional valve to the corresponding hydraulically actuated implement, pressure in the pressurized fluid passing through the proportional valve powering movement of the plurality of actuated implements, wherein all pressurized hydraulic fluid provided to the plurality of directional valves passes through the proportional valve.

14. The construction apparatus of claim 13, wherein the plurality of inputs includes a joystick and selector switch corresponding to one of a plurality of hydraulically actuated functions.

15. The construction apparatus of claim 12, wherein the proportional valve is a manually controlled valve.

16. The construction apparatus of claim 13, further comprising a processor configured to control the proportional valve.

17. The construction apparatus of claim 13, further comprising a processor configured to control the proportional valve and the plurality of directional valves.

18. The construction apparatus of claim 13, further comprising a second proportional valve adapted to receive input from at least one of the plurality of inputs.

19. A construction apparatus comprising:

a hydraulic pump adapted to produce pressurized hydraulic fluid;

a proportional valve adapted to control a flow rate of pressurized hydraulic fluid supplied by the hydraulic pump;

a plurality of hydraulically actuated implements;

a plurality of inputs, at least one of the inputs corresponding to the proportional valve, at least one of the inputs corresponding to one of the hydraulically actuated implements;

a plurality of directional valves in communication with the proportional valve and the plurality of hydraulically actuated implements, the plurality of directional valves adapted to receive input from the plurality of inputs and direct hydraulic fluid from the proportional valve to the corresponding hydraulically actuated implement, pressure in the pressurized fluid passing through the proportional valve powering movement of the plurality of actuated implements;

a first flow path extending from the proportional valve to at least one of the plurality of directional valves; and a second flow path extending from the hydraulic pump to the proportional valve, the first flow path is separate from the second flow path.

20. The construction apparatus of claim 19, wherein the plurality of directional valves are electro-hydraulic valves.

21. The construction apparatus of claim 19, wherein the proportional valve is an electro-hydraulic valve.

22. The construction apparatus of claim 19, wherein pressurized fluid provided by the hydraulic pump passes through at least one of the plurality of directional valves before passing back through the pump.

23. A construction apparatus comprising:

a hydraulic fluid source;

a first hydraulically actuated implement;

a second hydraulically actuated implement;

a hydraulic pump adapted to supply hydraulic fluid from the hydraulic fluid source to the first hydraulically actuated implement along a first flow path and from the hydraulic fluid source to the second hydraulically actuated implement along a second flow path;

a first directional valve positioned along the first flow path;

a second directional valve positioned along the second flow path; and a proportional valve adapted to control a flow rate of hydraulic fluid supplied by the hydraulic pump, the proportional valve having a first outlet in communication with the first flow path and a second outlet in communication with the second flow path.

24. The construction apparatus of claim 23, wherein the first flow path extends directly between the first outlet of the proportional valve and the first hydraulically actuated implement and the second flow path extends directly between the second outlet of the proportional valve and the second hydraulically actuated implement.

25. The construction apparatus of claim 23, wherein the proportional valve divides hydraulic fluid supplied by the hydraulic pump into the first and second flow paths.

* * * * *